US008495818B1

(12) United States Patent
Peppett

(10) Patent No.: US 8,495,818 B1
(45) Date of Patent: Jul. 30, 2013

(54) HAND DRIVEN CUTTER HAVING MULTIPLE WHEELS

(76) Inventor: Robert Anthony Peppett, Morasice (CZ)

( * ) Notice: Subject to any disclaimer, the term of this patent is extended or adjusted under 35 U.S.C. 154(b) by 0 days.

(21) Appl. No.: 13/461,061

(22) Filed: May 1, 2012

(51) Int. Cl.
*B26B 29/00* (2006.01)

(52) U.S. Cl.
USPC ..... 30/280; 30/282; 30/283; 30/289; 30/285; 30/286

(58) Field of Classification Search
USPC ..... 30/280, 282–286, 288–291, 293, 30/294, 312–314, 317, 320, 321; D8/98
See application file for complete search history.

(56) References Cited

U.S. PATENT DOCUMENTS

| | | | | | |
|---|---|---|---|---|---|
| 1,776,046 | A | * | 9/1930 | Schmidt | 30/293 |
| 2,567,102 | A | * | 9/1951 | Cook | 30/294 |
| 2,966,742 | A | * | 1/1961 | Harian | 30/314 |
| 3,009,247 | A | * | 11/1961 | Mueller | 30/294 |
| 3,137,192 | A | * | 6/1964 | McNeill | 30/123 |
| 3,513,744 | A | * | 5/1970 | Hershberger | 83/520 |
| 3,859,725 | A | * | 1/1975 | Anderson et al. | 30/294 |
| 4,001,936 | A | * | 1/1977 | Matsushita | 30/293 |
| 4,035,913 | A | * | 7/1977 | Madl et al. | 30/304 |
| 4,062,116 | A | * | 12/1977 | Arnott | 30/319 |
| 4,148,142 | A | * | 4/1979 | Sullivan et al. | 30/293 |
| 4,385,440 | A | * | 5/1983 | Webb | 30/294 |
| 4,527,750 | A | * | 7/1985 | Juntti | 83/614 |
| 5,438,757 | A | * | 8/1995 | Weschenfelder | 30/294 |
| 5,485,676 | A | * | 1/1996 | Terhorst | 30/294 |
| 5,715,605 | A | * | 2/1998 | Nadeau | 30/293 |
| 6,112,417 | A | * | 9/2000 | Hyer et al. | 30/290 |
| 6,226,824 | B1 | * | 5/2001 | Hopson et al. | 7/158 |
| 6,421,924 | B2 | * | 7/2002 | Anderson et al. | 30/294 |
| 6,484,404 | B1 | * | 11/2002 | Kao | 30/293 |
| 6,684,512 | B1 | * | 2/2004 | Bareis | 30/290 |
| 6,792,634 | B1 | * | 9/2004 | Mills et al. | 7/158 |
| D501,386 | S | * | 2/2005 | Diaz | D8/98 |
| 6,938,292 | B1 | * | 9/2005 | Iannacone, Jr. | 30/294 |
| 6,941,664 | B1 | * | 9/2005 | Engle et al. | 30/286 |
| 6,952,878 | B1 | * | 10/2005 | Bareis et al. | 30/294 |
| 6,964,075 | B1 | * | 11/2005 | Iannacone, Jr. | 30/294 |
| 8,220,162 | B2 | * | 7/2012 | Rayner | 30/292 |
| 2005/0229403 | A1 | * | 10/2005 | Diaz | 30/294 |
| 2006/0117574 | A1 | * | 6/2006 | Martin | 30/294 |
| 2008/0250654 | A1 | * | 10/2008 | Chang | 30/292 |
| 2011/0094344 | A1 | * | 4/2011 | Weedon | 30/320 |

FOREIGN PATENT DOCUMENTS

GB 2277705 A * 11/1994

* cited by examiner

*Primary Examiner* — Jason Daniel Prone
(74) *Attorney, Agent, or Firm* — Lyman Moulton, Esq.

(57) ABSTRACT

A hand held, manually driven cutting device comprises a two part substantially inverted 'V' shaped body. The two body parts assemble to form an ambidextrous graspable handle, and a pair of axled wheels attach to the outer surface of a rear leg and a front leg of each body part. The dividable body is dismantled to receive a detachable blade that when affixed has its cutting edge protruding beneath the assembled body midway between the two rear wheels. Also mounted beneath the assembled body is a combined safety shield and material lifting element provided with a flow passage. Four wheels to the assembled body are configured with one wheel on either side of the front lower distal, one wheel either side of the lower rear body. During the cutting process the lamina material lies above the lifting and supporting element and below the rear wheels.

11 Claims, 6 Drawing Sheets

HAND DRIVEN CUTTER HAVING MULTIPLE WHEELS

TECHNICAL FIELD

This invention relates to a wheeled, hand held, manually driven apparatus for conveniently cutting sheet material, in particular technical textiles used for making banners, tarpaulins, awnings, tents, sails and the like which during the fabrication process are spread in single sheet on a supporting surface wherein the material is cut into panels or segments, more particularly to a manual apparatus with simplicity of use which will accurately and speedily cut a wide variety of lamina material.

BACKGROUND OF THE INVENTION

Numerous manual, hand held tools for cutting industrial fabric or similar material have been provided in prior art. For example U.S. Pat. No. 4,062,116, U.S. Pat. No. 3,137,192, U.S. Pat. No. 6,226,824, U.S. Pat. No. 2,567,102, U.S. Pat. No. 6,964,075, U.S. Pat. No. 5,765,289, U.S. Pat. No. 4,001,936, U.S. Pat. No. 6,421,924, U.S. Pat. No 6,684,512, and U.S. Pat. No 6,938,292. While these units may be suitable for the particular purpose to which they address, they would not be suitable for the purposes of the present invention as heretofore described.

U.S. Pat. No. 4,062,116 discloses a fabric cutting tool. A fabric cutting tool comprising an elongated shank curved and bifurcated at one end and a handle on the other, the bifurcated end having a spring loaded rotary cutting blade rollingly mounted between the bifurcation, a protective shield of the blade, a pair of guide wheels for assisting in the cutting, and a foot plate providing a cutting surface for the fabric.

U.S. Pat. No. 3,137,192 discloses a material cutting device comprised of channel means of a pair of longitudinal portions arranged in a spaced relationship to provide a narrow longitudinal slot there-between, a vertical plate of a thickness substantially equal to the width of said slot and height substantially greater than the depth of said slot having two inclined downwardly inwardly converging cutting edges extending downwardly into the slot and converging at a portion that emerges from the underside of said channel means, oppositely extending lower surface anti-friction means normally attached to the two surfaces of said vertical plate at a portion emerging from the underside of the channel means, at least two upper surface anti-friction means located on each side of said vertical plate and making contact with the upper surface of the channel means astride the two points defined by the intersection of the cutting edges of such vertical plate and plane of the upper surface of said channel means, resilient means interposed between each of the anti-friction means on at least one side of the channel means and said vertical plate to cause all anti-friction means to grip their respective sides of the channel means.

U.S. Pat. No. 6,226,824 discloses a knife with multiple roller wheels comprising an elongate hollow housing adapted to be held and operated by one hand. The housing has a first end with a slot and an opposite second end. A knife blade is provided having a structure for retractably extending the knife blade from the slot in the first end of the housing to trim a window screen. Two roller wheels are provided. A facility is provided for rotatably supporting in a spaced apart relationship the two roller wheels. An assembly pivotally connects the supporting facility to one side of the housing adjacent to the second end. A stop member supports the supporting facility in a stationary position, so that one of the roller wheels will extend beyond the second end of the housing to install the window screen in a window screen frame.

U.S. Pat. No. 2,567,102 discloses a fabric cutter for cutting the back of a pile fabric comprising a cutting blade, a main vertical plate having a recess therein to receive said cutting blade and having a portion extending into said recess at its bottom and forming an abutment to support said cutting blade, said main plate having a portion extending forwardly of said abutment, said forwardly extending portion having a bottom surface in a horizontal plane above said abutment to ride on the back of the fabric being cut, means to guide the cutter vertically consisting of a horizontal plate secured to and extending laterally from the lower portion of the main plate and extending rear-wardly from said recess, the bottom surface of said horizontal plate being in the same horizontal plane, means to guide the cutter horizontally consisting of a portion of said main plate extending rear-wardly of said abutment, and a second vertical plate attached to said main plate and partially covering the recess in said plate, a portion of said second vertical plate extending forwardly of said recess wholly above the bottom surface of the forwardly extending portions of the main plate, whereby the portions of the horizontal plate and the main plate to the rear of the recess guide the cutter both vertically and laterally.

U.S. Pat. No. 6,964,075 discloses a bi-directional carpet trimmer and tucker tool having recesses receiving blades in a generally horizontal or slightly angled orientation. The blades and recess have a structure to inhibit rotational and translational movement of the blades in the tool. The tool has a trailing guide engaging trailings trimmed from an edge of carpet to be tucked. The trailings guide moves the trailings away from at least one tucking wheel along a path generally between a handle and the at least one tucking wheel. This guiding operation inhibits interference of the trailings with tucking and trimming operations.

U.S. Pat. No. 5,765,289 discloses a rotary cutter which includes an elongated handle having a gripping portion connected to a platform having a peripheral edge. A generally circular blade is rotatably mounted on a shaft extending through an aperture formed in the platform. The cutter also includes a blade guard having an accurate portion. The guard is rotateable by the user to expose the cutting edge of the blade prior to using the cutter.

U.S. Pat. No 4,001,936 discloses a carpet cutter to cut any excess edge of a carpet to suit the size of a room. It includes a bed plate to be slid on the carpet, a guide plate at front of the bed plate to be pressed against the wall, a slanting blade mounting plate in the rear of the guide plate, a pair of blades mounted on the blade mounting plate, and a pair of pressure rollers disposed outside of the blades for pressing down the carpet against the floor just before cutting. The clamping nuts of the blades are tightened in reverse direction to each other.

U.S. Pat. No. 6,421,924 discloses a cushion back carpet cutting tool. The tool includes a leading edge on the center plate that opens the adjacent rows of tufts in the carpeting, three blades for cutting the carpeting between adjacent rows. The leading edge has an angle of less than 90 degrees from the horizontal and is rounded in shape to prevent loop or woven carpeting from catching on the tool. The blades are kept in place at an angle of between 15 to 25 degrees from the bottom edge of the tool which results in a smoother cut.

U.S. Pat. No. 6,684,512 discloses a rolling device for cutting sheet material including a planar body member supported vertically on wheeled axles oriented perpendicularly to the vertical planar body member. The planar body member includes a cutting notch and a contained cutting blade member with a cutting edge exposed within the cutting notch. A handle member is secured to the planar body member and extends upwardly opposite the wheeled axles. A crossbar can be attached to the handle member. A user grasps the handle member, or crossbar, and rolls the planar body member forward on the wheeled axles to cut a sheet of material passing into the cutting notch.

U.S. Pat. No. 6,938,292 discloses a bi-directional carpet trimmers and tucker. The trimmers may be adjusted or sized to trim the carpet edge to the correct length for tucking. At least two trimmers are provided, one for each direction of operation. The height offset of the trimmers above the carpet trimmer and tucker baseplate may be fixed or may be adjustable to allow for variances in carpet thickness and different depths of the trucking trough. Guides extend from the trimmers to slidingly or rollingly engage the wall or baseboard and to orient the trimmers. The trimmer blades are oriented horizontally. The invention also includes a retrofit trimmer for existing carpet tuckers. The retrofit kit comprises a replacement handle, or grip, with integral or attachable trimmers extending to align with the wheels of existing 3-wheeled carpet trimmers.

OBJECT OF THE INVENTION

The cutting device according to the invention is especially designed to handle technical textiles, particularly those made from synthetic materials, at the same time due to its design it is safe, efficient and very easy to use.

One object of the invention is to provide a hand held manually driven cutting device especially designed for cutting technical textiles that in most situations can cut as quickly and accurately as battery powered rotating knife's such as those commonly used by banner, tarpaulin, awning, tent and sail fabrication industries, at the same time it is, due to its design more cheaply available to the end user, furthermore unlike rotating knife's it performs a technical textile cutting operation without consuming energy resources.

Another object is to provide an ambidextrous cutting device that can be operated using a single hand with equal facility by both left and right handed operator.

A further object is to provide a cutting device for which it is possible to use commonly available cutting blades such as the blades found in low cost craft knife's.

A still further object is to provide a cutting device presenting an ergonomic design, in a preferred embodiment the ergonomic design is of a substantially inverted 'V' shaped body also known as a cuneal shape herein with its distal point or forward leg of the 'V' being the forward facing element, the lower facets of the cuneal shaped body are substantially planar upon which are attached by axles a plurality of wheels.

A still further object is to provide a cutting device with a substantially cuneal shaped graspable body made of resilient material.

A still further object is to provide a cutting device having a graspable body that is dividable into two parts along its vertical axis.

A still further object is to provide a cutting device that utilizes a craft knife cutting blade that is held in position through being clamped between both parts of the dividable graspable body such that when the two body parts are assembled the craft knife cutting edge becomes projecting from the underside of the graspable body with the cutting edge of the knife blade facing toward the distal leading point of the cuneal shaped graspable body which is the direction of travel.

A still further object is to provide a cutting device with a material lifting and supporting element extending from the underside of the graspable body, the lifting and supporting element becomes clamped into position when both parts of the graspable body are affixed together by means of screws.

A still further object is to provide a cutting device with a lifting and supporting element being thin with its distal edge facing forward between the plurality of wheels wherein an engagement space for material to be lifted is apportioned between the distal edge of the lifting and supporting element and the front wheels of the device, such that when material to be cut is introduced beneath the front wheels of the cutting device, when the device is moved forward the material to be cut is lifted upon the upper surface of the lifting element and as the device is driven forward material to be cut becomes clamped beneath the rear wheels simultaneous with passing above the lifting element and becoming introduced to the cutting edge of the knife blade.

A still further object is to provide a cutting device that during the device operation the lifting and supporting element prevents any possibility of accidental human contact with the knife blade.

A still further object is to provide a cutting device that due to its irregular cuneal shape, when gripped and manually moved forward it applies inclined downward pressure through its wheels onto the material being cut wherein the possibility of rucking or movement of the material during the cutting process is considerably diminished.

SUMMARY OF THE INVENTION

A hand held cutting device is described. More particularly wherein the graspable body is of a substantially cuneal shape such that when the device is clasped by the hand of the user to impart a forwardly actuating force, the substantially cuneal shape defines an inclined force entry direction whereby in association with the actuating rolling motion clamping down force is applied through the wheels upon the material to be cut. The hand held cutting device comprises a two part dividable rigid substantially cuneal shaped body assembly, each body part having a mirror image outer surface and periphery that when coupled with its partner the resultant assembly forms an ambidextrous graspable handle; a knife blade clamped firmly between the two body parts with its cutting edge protruding forwardly beneath the cuneal shaped body; a pair of front wheels, each wheel attached to an axle, situated to lower distal point on either outer side of the cuneal body assembly; a pair of rear wheels, each wheel attached to an axle situated to the lower rear on either outer side of the cuneal body assembly such that the cutting edge of said knife blade is situated in a central position midway between the rear wheels; a lifting and supporting element extending from the underside of the cuneal body wherein an engagement space for material to be lifted is apportioned between the distal front edge of the lifting and supporting element and the front wheels of the device facing the direction of travel, the lifting and supporting element is arranged to lift the material to be cut and also form a protecting periphery such that any part of cutting edge of the knife does not protrude outside the periphery, the lifting and supporting element includes a flow passage configured to pass opposing sides of the cutting blade; the knife blade and supporting element are supported and clamped in position by the two halves of the cuneal body which are connectedly joined together by a jointing means. To improve cut ability the flow passages are inclined, the leading edge of the flow passage being flush at the distal front upper surface of said lifting and supporting element, the flow passage extending rearward with an upward inclination to peak upon adjacent sides of the knife blade such that when the device is driven forward wherein material to be cut is introduced upon the leading edge of the lifting and supporting element the flow passages guide the material to be cut into an actuated pincer and shearing action between the crest of the flow passage, the peripheral underside of the body and the cutting edge of the knife blade. The cuneal shaped body is provided with smoothly curved peripheral surface that provides graspable comfort for the operator, a graspable handle being the cuneal rearmost outer body periphery extending outward and downward from the irregular cuneal altitudinal apex and rear-wardly away from the cuneal body distal point, cuneal distal point being the front of the cutting device and direction of travel.

The two part body has symmetrical features to enable practical use by both left and right handed operator; the two part body is detachable/attachable to allow for interchanging the knife blade. The forward wheels are positioned to the outer lower distal point of the cuneal body enabling pressure upon material being cut thereby preventing rucking when the cutter is driven in a forward direction. The rear wheels are positioned to the outer lower rear of the handle housing on opposing sides and adjacent to the cutting edge of the knife blade, whereby in addition to enabling the cutter to travel the rear wheels substantially clamp in position the material to be cut at the moment the material meets with the knife blade during the hand driven cutting process.

The front and rear wheels are affixed in symmetrical positions enabling and encouraging the cutter to be manually driven forwardly in a continuous linear direction. The knife blade to be clamped in the body is of proprietary replaceable type.

The knife blade protrudes from the rear underside of the cuneal shaped body, also known herein as a substantially inverted 'V' shaped body with its cutting edge facing the distal point of the cuneal body, the distal point being the direction of travel. The lifting and supporting element extending from the underside of the body is arranged to form a protecting periphery such that any part of a cutting edge of the knife blade does not protrude outside of said periphery. The lifting and supporting element is in the form of a planar metallic panel upon the rear central axis of which is configured a flat central core rising vertically situated behind and aligned with the blunt edge of the knife blade, wherein said flat central core rises to a point whereupon it is held in position by being clamped in position between the two halves of the cuneal body.

BRIEF DESCRIPTION OF THE FIGURES

The foregoing features, objects and advantages of the invention will become apparent to those skilled in the art from the following detailed description of a preferred embodiment, especially when considered in conjunction with accompanying drawings in which like numerals in the several views refer to corresponding parts.

DETAILED DESCRIPTION OF THE PREFERRED EMBODIMENT

Figure 1:
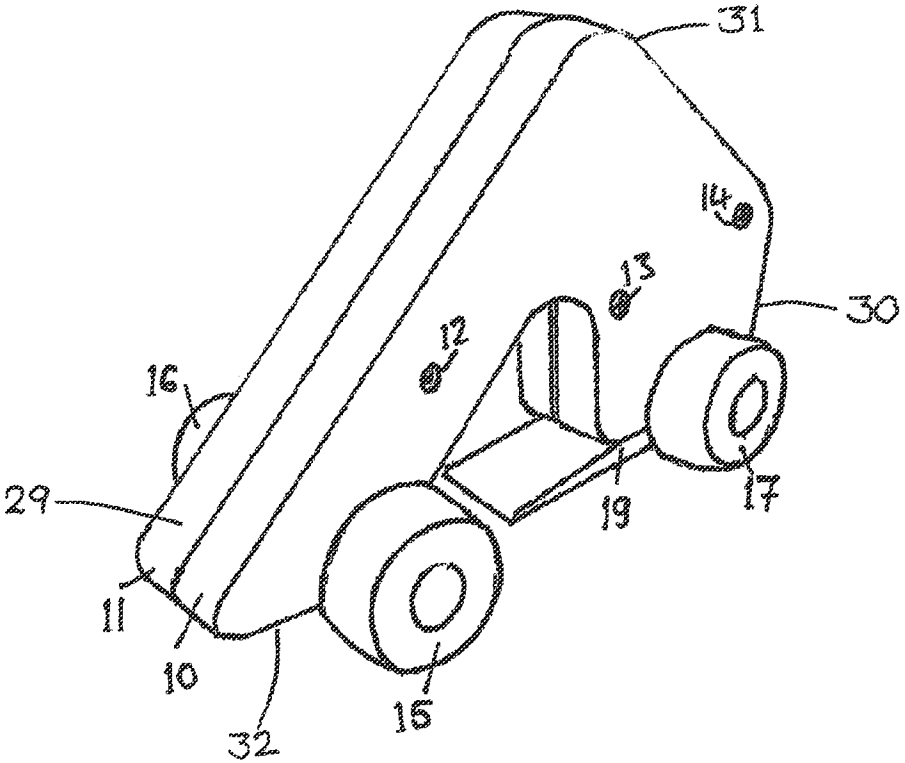
FIG. 1 is a perspective view of the hand driven cutting device.
Figure 2:
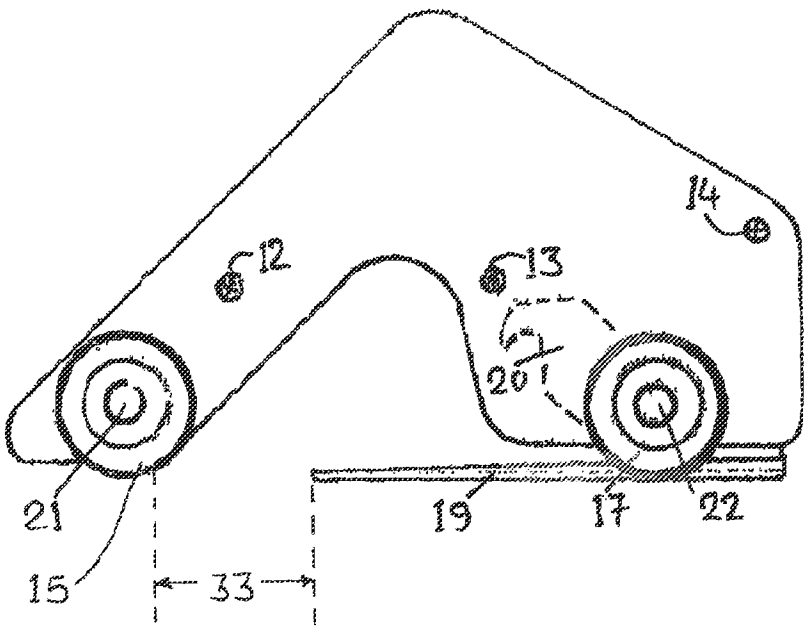
FIG. 2 is a right-side elevation view of the hand driven cutting device.

Turning now descriptive to the drawings, in which similar reference characters denote similar elements throughout the several views. In FIG. 1 and FIG. 2 the hand driven cutting device is shown. FIG. 1 shows a two part dividable rigid substantially inverted 'V' shaped body (10,11) each body part having an identical outer surface and periphery that when coupled with its partner forms an ambidextrous graspable handle. The body part (10,11) can be made up of any material such as wood, steel, aluminum or durable plastic. Further, each body part (10,11) having front leg or side (29), rear leg or side (30), upper side (31) and bottom side (32), as illustrated in FIG. 1. And also, placement of the front wheels (15, 16) on the front leg or side (29) of the body part is higher, making the body part lower to a work surface than the placement of the rear wheels (17, 18) on the rear leg or side (30 ) of the body part to the same work surface.

The two rigid body parts (10,11) are coupled together by screws 12,13 and 14 as shown in FIG. 1. A pair of front wheels, (15,16) each wheel attached to an axle (21) are configured substantially toward the lower distal point on either side of the cuneal shaped body (10,11). A pair of rear wheels, (17,18) each wheel attached to an axle (22) the rear wheels are configured to the lower rear on either side of the cuneal shaped body.

FIG. 2 shows a knife blade (20) with its cutting edge protruding from the bottom side of the cuneal shaped body (10,11). The knife blade is clamped toward the lower rear in between the cuneal shaped bodies (10 11) and is configured with its cutting edge facing the distal front of the device and aligned with the axis of the two rear wheels (10,11). A lifting and supporting element (19) extending from the underside of the cuneal shaped body (10,11), the lifting and supporting element has a flow passage that is inclined upward towards the cutting knife and its forward facing leading edge is inclined downward to lift the material to be cut wherein the overall planar body is configured to form a protecting periphery such that any part of the cutting edge of the knife blade (20) does not protrude outside the periphery; wherein an engagement space for material to be lifted (33) as illustrated in FIG. 2 is apportioned between the leading edge of the lifting and supporting element and the front wheels of the device.

The supporting element includes a flow passage configured to pass adjacent sides of the knife blade.

Figure 3:
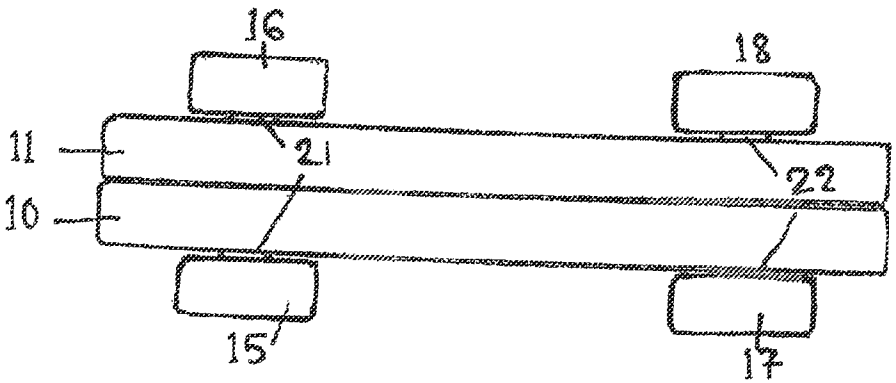
FIG. 3 is a top-plan view of the hand driven cutting device.
Figure 5:
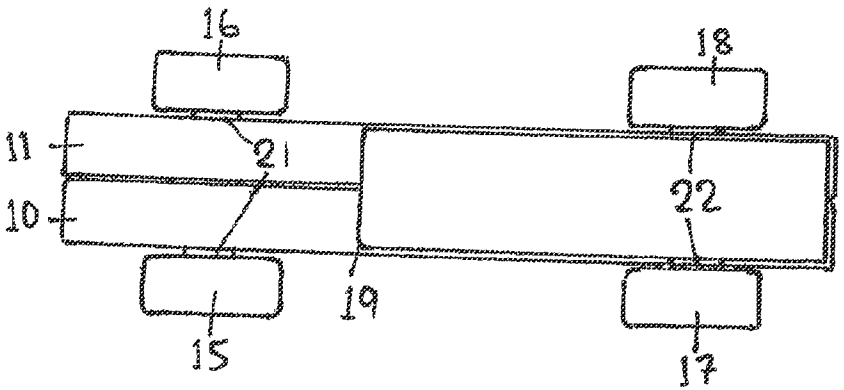
FIG. 5 is a bottom plan view of the hand driven cutting device.

FIG. 3 and FIG. 5 show substantially where the wheels are connected via axles to each of the cuneal shaped body parts (10, 11). There are a pair of front wheels (15,16) each wheel attached to the front portion of cuneal shaped body through an axle (21). A pair of rear wheels (17,18) are attached to the rear side of the cuneal shaped body (10,11) through an axle (22). FIG. 5 also shows the position of the lifting and supporting element (19) that is positioned beneath the cuneal shaped body between the inner alignment of front and rear wheels.

Figure 4:
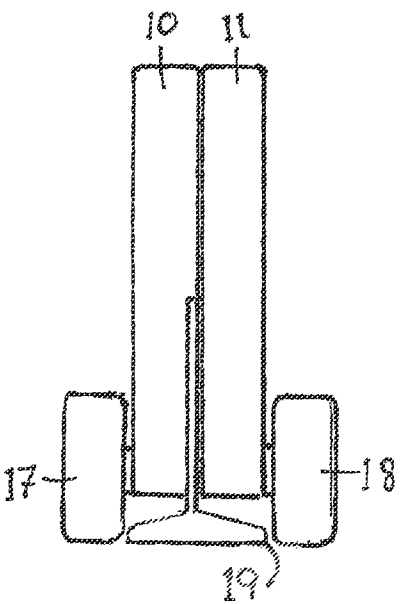
FIG. 4 is a back elevation view of the hand driven cutting device.

FIG. 4 shows the back side view of the hand driven cutting device. The lifting and supporting element (19) is affixed in position in such a manner that there is a small gap between the bottom peripheral of the cuneal shaped body (10,11) and the upper surface of the flow passage of the lifting and supporting element (19). This gap provides the flow passage for the material to be cut and when the device is driven forward the flow passage guides the material to be cut into an actuated pincer and shearing action between the crest of the flow passage, the peripheral underside of the body and the cutting edge of the knife blade.

Figure 6:
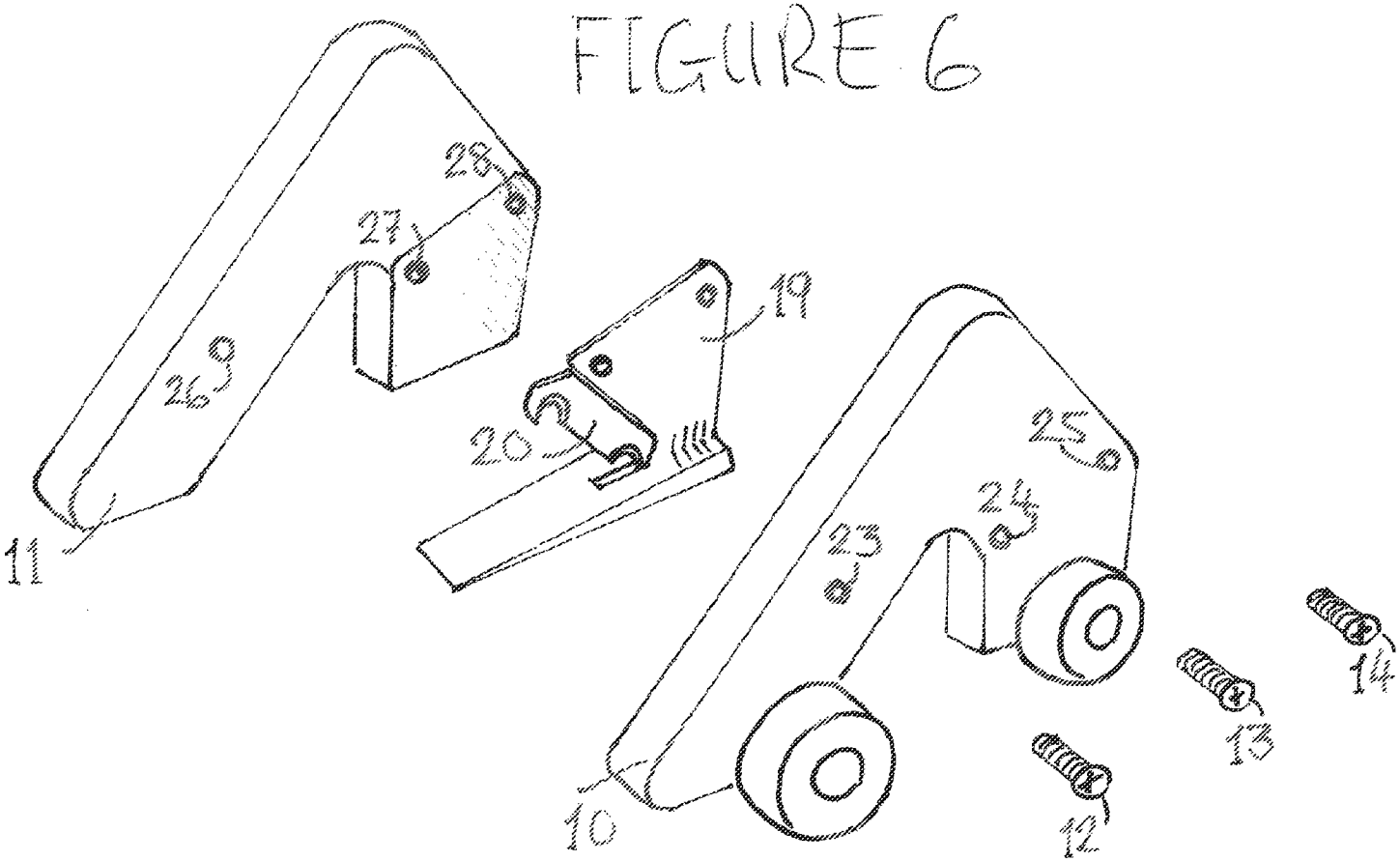
FIG. 6 is a pre-assembly perspective view of the hand driven cutting device.

FIG. 6 shows the pre-assembly view of the hand driven cutting device. The substantially cuneal shaped body parts (10) and (11) are shown separately. The knife blade (20) and the vertical fin of the lifting and supporting element (19) becomes clamped firmly in position when the two sides of the cuneal body are joined together. FIG. 6 shows how the cuneal shaped body parts (10) and (11) are coupled together. The cuneal shaped body part (10) has holes to receive jointing screws (23), (24) and (25). Similarly the other cuneal shaped body part (11) is having corresponding holes (26), (27) and (28). The holes are made at similar locations in both half's of the cuneal shaped bodies (10) and (11). The vertical fin of the lifting and supporting element also has holes through which a jointing screw is passed in order to hold it firmly in position. When the two half cuneal shaped bodies (10) and (11) are coupled the knife blade (20) and the vertical fin of the lifting and supporting element (19) are clamped between the bodies. At the time of coupling, the screw (12) is tightened in the holes (23) and (26). The screw (13) is tightened in the holes (24), (29) and (27). The screw (14) is tightened in the holes (25), (30) and (28). When these screws are tightened the cuneal shaped hand cutting device is ready for use.

When screws 13 and 14 are tightened the knife blade (20) is firmly clamped in a protruding position to the underside of the cuneal shaped body assembly, such that no part of the knife comes outside of the cuneal shaped body also known as the substantially inverted 'V' shaped body and its supporting element (10, 11).

OPERATION OF THE DEVICE

The hand driven cutting device when manually driven forward upon a work surface utilizes its wheels to provide motion and apply stabilizing down force and clamping of lamina material whilst simultaneously cutting it. Also mounted within the graspable body is a combined safety shield and material lifting and supporting element (19) situated beneath the body below the knife blade (20) with its distal edge protruding forwardly enough to enable picking up of material to be cut. The lifting and supporting element (19) has on its upper surface a flow passage that is configured to pass opposing sides of the cutting knife blade (20), the flow passage is inclined upwardly away from the leading edge of the lifting and supporting element with trailing edge of the flow passage becoming higher toward the rear of the device so during the cutting process material passing over it becomes guided into an actuating pincer and shearing action that takes place between the crest of the flow passage the peripheral underside of the body and the cutting edge of the knife blade. Wheels (15, 16) with corresponding axles are provided to the lower edge of the leading point of the cuneal shaped body, a further pair of wheels (17,18) are mounted towards the lower rear of the body, each rear wheel on opposing sides and adjacent to the cutting edge of the knife blade (20) whereby in addition to enabling the hand driven cutting device to travel, during the hand driven process when the material to be cut is traversing the lifting and supporting element, at the point of reaching the cutting edge of the knife blade the material is simultaneously positioned beneath a downward pressure point being correspondingly actuated upon the rear wheels (17,18).

When the cutting operation is started, the hand driven cutting device is placed near the edge of lamina material to be cut, in such a manner that the front wheels (15,16) are firstly placed on the upper surface of the lamina material, the device is then driven forward whereupon the edge of the material to be cut is picked up by the leading edge of the lifting and supporting element wherein upon the device being driven further forward the forward half of the lifting and supporting element (19) lies below the lamina material whilst rear wheels (17,18) are lying at the ground surface.

When force is applied in a further forward direction and the rear wheels (17,18) also come on the upper surface of the lamina material the lamina material comes in contact with and becomes cut by the blade. During the forward movement of the hand driven cutting device the lamina material passes over the lifting and supporting (19) element and beneath the rear wheels (17,18) wherein a combination of clamping pressure upon the rear wheels, stresses actuated through the lifting of the lamina material at the point upon which the material reaches the cutting edge of the knife blade, thereupon a smooth cutting operation is performed. At any time during the cutting process the lamina material lies above the lifting and supporting element and below the rear wheels (19).

It is noted that the embodiment of the hand driven cutting device with multiple wheels described herein in detail for exemplary purpose is of course subject to many different variations in structure, design, application and methodology. Because many varying and different embodiments may be made within the scope of inventive concepts herein taught, and because many modifications may be made in the embodiment herein detailed in accordance with the descriptive requirements of the law, it is to be understood that the details herein are to interpreted as illustrative and not in a limiting sense.

What is claimed is:

1. A hand held manually driven cutting device, comprising:

a substantially inverted V-shaped body having a front leg and a rear leg comprising a first substantially inverted V-shaped body part and a second substantially inverted V-shaped body part attachable to the first body part via a fastener and having a mirror image outer surface and periphery to that of the first body part;

a knife blade having a cutting edge being clamped between the first and second body parts adjacent the rear leg, the cutting edge protruding beneath a bottom periphery of the substantially inverted V-shaped body;

a pair of front wheels, each of the front wheels being attached to a respective side of an axle at a front lower distal periphery of the front leg;

a pair of rear wheels, each of the rear wheels being attached to a respective side of an axle at a rear lower distal periphery of the rear leg such that the knife blade is centered midway between the rear wheels;

a lifting and supporting element extending from the rear lower distal periphery of the rear leg and defining a protecting periphery such that cutting edge does not protrude outside the protecting periphery, the lifting and supporting element includes a supporting surface defining a leading edge facing the front leg and is configured to pick up a material work piece to be cut, and the lifting and supporting element includes a central vertical supporting fin that is held in place between the first and second body parts by the fastener.

2. The hand held manually driven cutting device of claim 1, wherein when the device is grasped by a hand of a user to impart a forwardly actuating force in association with a downward force applied through the wheels upon the material work piece being cut, wherein the downward force causes an element of entrapment upon the work piece thereby causing the material work piece to come under stressful resistance at a point of coming into contact with the cutting edge of the knife blade.

3. The hand held manually driven cutting device of claim 1, wherein the mirror image outer surfaces and peripheries of the body parts enable ambidextrous use by an operator.

4. The hand held manually driven cutting device of claim 1, wherein the fastener is a screw that allows for the first and second body parts to be detachable from and attachable to each other which further allows for replacement of the knife blade when the body parts are detached from each other.

5. The hand held manually driven cutting device of claim 1, wherein the front wheels apply pressure upon the material work piece being cut thereby preventing rucking when the device is driven in a cutting direction.

6. The hand held manually driven cutting device of claim 1, wherein the rear wheels clamp the material work piece in place during cutting.

7. The hand held manually driven cutting device of claim 1, wherein the front wheels are symmetrical in relation to the body, the rear wheels are symmetrical in relation to the body, and the wheels enable the device to be manually driven in a cutting direction.

8. The hand held manually driven cutting device of claim 1, wherein the knife blade is at least one of a proprietary replaceable knife blade and a commodity replaceable knife blade.

9. The hand held manually driven cutting device of claim 1, wherein the knife blade is configured to protrude from the rear lower distal periphery of the rear leg with the cutting edge facing the front leg and a direction of travel.

10. The hand held manually driven cutting device of claim 1, wherein the supporting surface is a metallic wedge and the fin extends adjacent to a blunt edge of the knife blade.

11. The hand held manually driven cutting device of claim 1, wherein a bottom of the supporting surface lies flush with a bottom of the rear wheels.

* * * * *